US005664963A

United States Patent [19]

Yamamoto et al.

[11] Patent Number: 5,664,963

[45] Date of Patent: Sep. 9, 1997

[54] PRESS-CONNECTING JOINT CONNECTOR INCLUDING A RECEIVING STAND FOR CUTTING EXCESS WIRE PORTIONS

[75] Inventors: Hiroshi Yamamoto; Akira Kato, both of Shizuoka, Japan

[73] Assignee: Yazaki Corporation, Tokyo, Japan

[21] Appl. No.: 685,979

[22] Filed: Jul. 22, 1996

Related U.S. Application Data

[62] Division of Ser. No. 567,248, Dec. 5, 1995.

[30] Foreign Application Priority Data

Dec. 5, 1994 [JP] Japan ..... 6-300775

[51] Int. Cl.[6] ..... H01R 4/24

[52] U.S. Cl. ..... 439/409; 439/392; 439/417

[58] Field of Search ..... 439/409, 417, 439/392; 83/929.2, 856, 947, 950; 29/835, 564.3, 564.4, 564.8, 566.1, 566.2, 566.3, 566.4

[56] References Cited

U.S. PATENT DOCUMENTS

| | | | |
|---|---|---|---|
| 3,866,295 | 2/1975 | Tucci | 29/566.3 |
| 4,444,447 | 4/1984 | Markwardt | 339/98 |
| 4,834,668 | 5/1989 | Markwardt | 439/392 |
| 4,908,941 | 3/1990 | Fukuda et al. | 29/564.8 |
| 5,412,861 | 5/1995 | Fudoo et al. | 29/564.2 |

FOREIGN PATENT DOCUMENTS

| | | | |
|---|---|---|---|
| 58-214283 | 12/1983 | Japan | H01R 4/24 |
| 61-77564 | 5/1986 | Japan | H01R 4/24 |
| 941659 | 1/1994 | Japan | H01R 4/24 |

*Primary Examiner*—David L. Pirlot
*Assistant Examiner*—Tho Dac Ta
*Attorney, Agent, or Firm*—Sughrue, Mion, Zinn, Macpeak & Seas

[57] ABSTRACT

A press-connecting joint connector with which electrical wires can be readily connected to each other, and a method of press-connecting the electrical wires to the connector. The joint connector (31) includes a connector body (33) with a wire inserting section (47) in which the wires are to be inserted and a press-connecting blade (43) provided in the wire inserting section (47). The wires (W1) and (W2) are inserted in the wire inserting section (47) and the insulation of the wires is cut by the blade such that the blade electrically interconnects the wires. Thereafter, a cutter is inserted into the connector body to thereby cut the waste end portion (105) of at least one of the wires inside the connector body (33). The cutting step may be performed simultaneously to when the wires are pressed into the blades.

3 Claims, 5 Drawing Sheets

PRESS-CONNECTING JOINT CONNECTOR INCLUDING A RECEIVING STAND FOR CUTTING EXCESS WIRE PORTIONS

This is a divisional of application Ser. No. 08/567,248 filed Dec. 5, 1995.

BACKGROUND OF THE INVENTION

1. Field of the Industrial Application

This invention relates to a press-connecting joint connector having a press-connecting blade for press-connecting electrical wires to each other.

2. Description of the Related Art

FIG. 7 shows a press-connecting joint connector 1 which has been disclosed in Japanese Utility Patent Application (OPI) No. 77564/1986 (the term. "OPI" as used herein means an "unexamined publication application"). The joint connector 1 comprises: a connector body 7 having wire receiving grooves 3 and 5; press-connecting blades 9 and 11 provided respectively in the wire receiving grooves 3 and 5; and a cover 13 adapted to cover the upper opening 21 of the connector body 7. The cover 13 includes locking arms 17 having engaging holes 15, while the connector body 7 includes engaging protrusions 19 which are engaged in the engaging holes of the locking arms 17. When the upper opening 21 of the connector body 7 is closed with the cover 13, the engaging protrusions 19 are engaged in the engaging holes 15, so that the cover 13 is fixedly secured to the connector body 7. The cover 13 has wire pressing portions 23 on its inner surface which extend longitudinally. Hence, when the upper opening 21 of the connector body 7 is closed with the cover 13, electrical wires W1 and W2 laid in the wire receiving grooves 3 and 5 are pressed into the wire press-in grooves 9*a* and 11*a* of the press-connecting blades 9 and 11.

The electrical wires W1 and W2 are connected as follows. First the wires W1 and W2 are placed in the wire receiving grooves 3 and 5, and then the upper opening 21 of the connector body 7 is closed with the cover 13. As a result, the wires W1 and W2 are pressed into the wire press-in grooves 9*a* and 11*a* by the wire pressing portions 23 of the cover 13. Thus, the wires W1 and W2, being pressed, are connected to each other.

The wire W1 is a main wire, and the wire W2 is a branch wire which is connected to the main wire W1. As shown in FIG. 8, the wire W1 has one end portion 25 which is protruded from the joint connector 1 (hereinafter referred to as "a waste end portion 25", when applicable). The length of the waste end portion 25 is variable depending on how the worker sets the wire W1 in the wire receiving groove 3 of the connector 1. Hence, as shown in FIG. 9, the waste end portion 25 is fixedly set on the wire harness 27 being wrapped with an insulating tape 29, which prevents the end of the Wire W1 from being shorted to the vehicle body.

In the case where electrical wires are connected to each other with the press-connecting joint connector 1, the waste end portion of the wire protruded from the connector 1 must be fixedly held on the wire harness 27 with the insulating tape 29. This means that the connection of the electrical wires requires a relatively large number of working steps; that is, it takes time and labor.

In addition, the tape 29 must be wound on the wire harness 27 so that the conductor of the waste end portion of the wire is not exposed. Hence, the tape winding is rather troublesome, and must be performed with care.

Accordingly, an object of the invention is to provide a press-connecting joint connector with which electrical wires can be readily connected to each other, and a method of press-connecting the electrical wires to the connector.

SUMMARY OF THE INVENTION

The foregoing object of the invention has been achieved by the following arrangement.

The present invention includes a joint connector which comprises a connector body with a wire inserting section in which the plurality of wires are to be inserted; and a press-connecting blade provided in the wire inserting section. According to a first aspect of the invention, the plurality of wires are inserted in the wire inserting section, and simultaneously to when the plurality of wires thus inserted are pressed against the press-connecting blade so as to be press-connected to one another, a waste end portion of at least one of the plurality of wires is cut away inside the connector body.

Hence, the cut end of the wire is located inside the connector body; that is, the waste end portion is never left extended from the connector body.

According to a second aspect of the invention, the plurality of wires are inserted in the wire inserting section, and after the plurality of wires thus inserted are pressed against the press-connecting blade so as to be press-connected to one another, a waste end portion of at least one of the plurality of wires is cut inside the connector body. Hence, the cut end of the wire is located inside the connector body; that is, the waste end portion is never left extended from the connector body.

Finally, according to a third aspect of the invention, the connector body has a hole into which a cutting jig is inserted. Simultaneously to when or after the plurality of wires are pressed against the press-connecting blade so as to be press-connected to one another, the cutting jig cuts away a waste end portion of at least one of the plurality of wires inside the connector body. Hence, the cut end of the wire is positioned inside the connector body.

DETAILED DESCRIPTION OF THE INVENTION

Figure 1A:
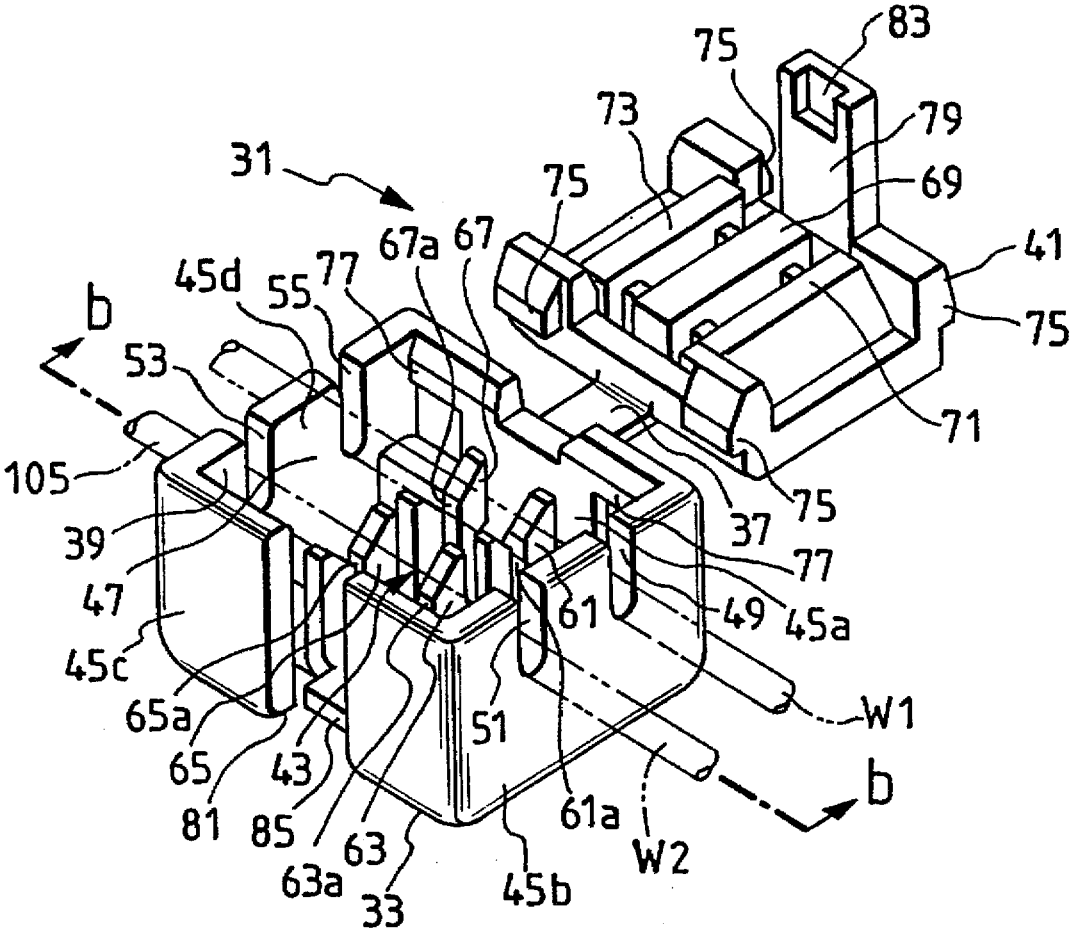
FIGS. 1(*a*) and (*b*) show an example of a press-connecting joint connector according to a first embodiment of the invention wherein FIG. 1(*a*) is a perspective view of the press-connecting joint connector, and FIG. 1(*b*) is a sectional view taken along line b—b in FIG. 1(*a*) showing the inside of the connector body of the press-connecting joint connector.
Figure 1B:
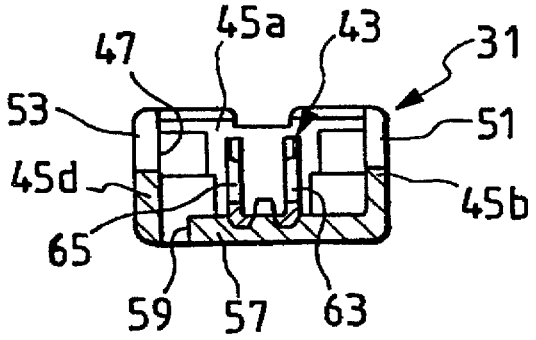
Figure 2A:
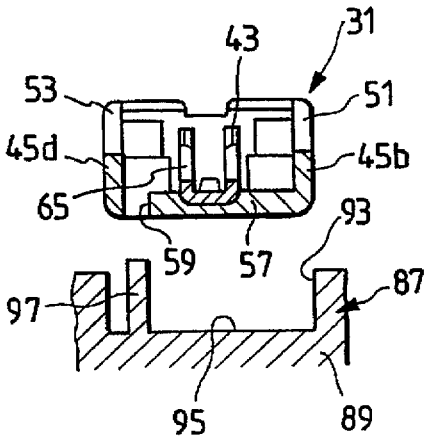
FIGS. 2(*a*)–(*c*) show a method of press-connecting electrical wires to the press-connecting joint connector according to the first embodiment of the invention wherein FIG. 2(*a*) is a sectional view showing the connector body which is about to be placed in the receiving recess of a cutting jig, FIG. 2(*b*) is a sectional view showing the electrical wires which are about to be set in the connector body, and FIG. 2(*c*) is also a sectional view showing the electrical wires which have been set in the connector body.
Figure 3A:
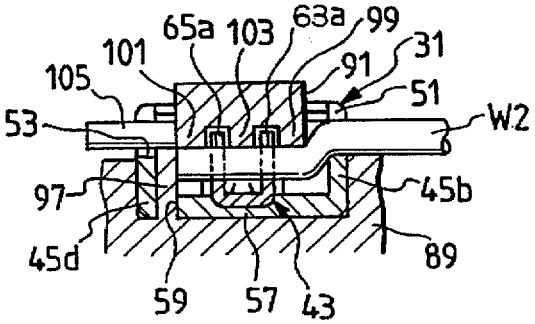
FIGS. 3(*a*) and (*b*) are diagrams for further description of the method of press-connecting electrical wire to the press-connecting joint connector according to the invention wherein FIG. 3(*a*) is a sectional view showing an arrangement in which electrical wires have been pressed with a pressing stand, and the waste end portion of one of the electrical wires has been cut away, and FIG. 3(*b*) is a sectional view showing the pressing stand which has been disengaged from the receiving stand of the cutting jig.
Figure 2B:
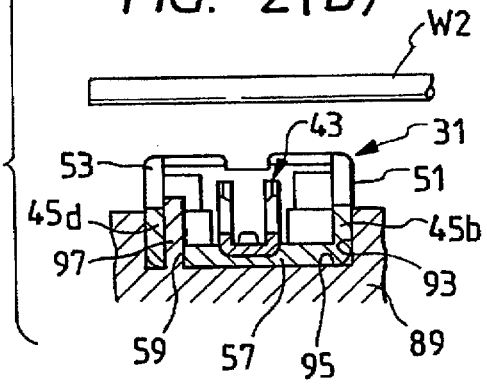
Figure 3B:
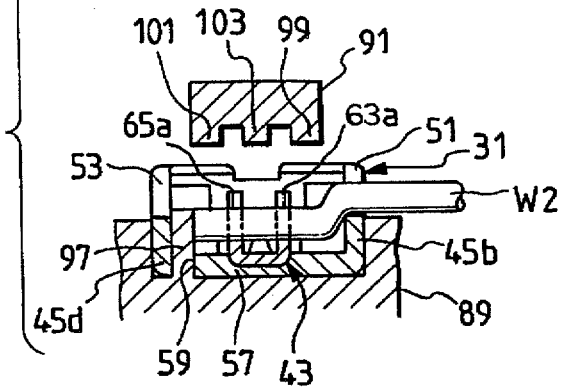
Figure 2C:
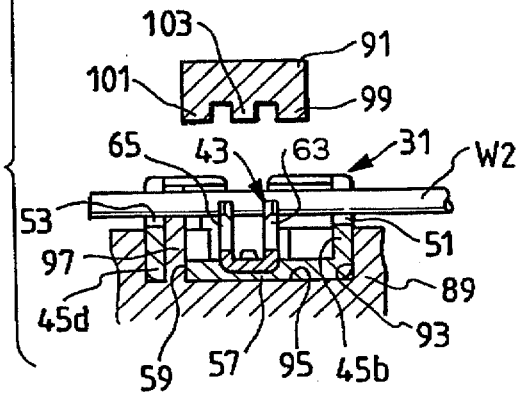

A press-connecting joint connector, and a method of press-connecting electrical wires to the connector, which constitute a first embodiment of the invention, will be described with reference to FIGS. 1, 2 and 3. FIG. 1(*a*) is a perspective view of the press-connecting joint connector 31, and FIG. 1(*b*) is a sectional view showing the inside of the connector 31. FIGS. 2(*a*), (*b*) and (*c*) are sectional views for facilitating a description of a procedure of press-connecting electrical wires with the press-connecting joint connector 31. FIGS. 3(*a*), and (*b*) are also sectional views for facilitating a description of a procedure of press-connecting electrical wires with the press-connecting joint connector 31.

As shown in FIG. 1(*a*), the press-connecting joint connector 31 comprises: a box-shaped connector body 33; a cover 41 which is coupled through a hinge 37 to one side wall 45*a* of the connector body 33, and is engaged with the upper opening 39 of the connector body 33; and a press-connecting blade 43 provided inside the connector body 33 so that electrical wires W1 and W2 are pressed against the blade 43.

The connector body 33 has side walls 45*a*, 45*b*, 45*c* and 45*d* which define a wire inserting section 47. The side walls 45*b* and 45*d*, which are opposite to each other, have wire receiving grooves 49 and 51, and wire receiving grooves 53 and 55, respectively. Two electrical wires W1 and W2, which are to be connected to each other, are set in those wire receiving grooves 49, 51, 53 and 55. The press-connecting blade 43 is positioned between the side walls 45*b* and 45*d*. A bottom wall 57 has a hole 59 between the side wall 45*d* and the blade 43 as shown in FIG. 1(*b*). A protrusion 97 of a cutting jig 87 is insertable into the hole 59, so that the waste end portion of the wire W2 which has been pressed against the press-connecting blade 43 may be cut away. The wire W1 is a main wire, and the wire W2 is a branch wire.

As shown in the parts FIGS. 1(*a*) and (*b*), the blade 43 is substantially U-shaped in section, having four press-connecting walls 61, 63, 65 and 67. The press-connecting walls 61 and 67 are positioned between the wire receiving grooves 49 and 55, while the press-connecting walls 63 and 65 are positioned between the wire receiving grooves 51 and 53. The press-connecting wall 61 has a wire press-in grooves 61*a* at the middle as viewed in the direction of width thereof. Similarly, the remaining press-connecting walls 63, 65 and 67 have wire press-in grooves, 63*a*, 65*a* and 67*a* in the same manner, respectively. More specifically, the wire press-in grooves 61*a*, 63*a*, 65*a* and 67*a* are defined by sloped surfaces which are opened upwardly from the positions which correspond to the bottoms of the wire receiving grooves 49, 51, 53 and 55. Hence, the wire W1 set in the wire receiving grooves 49 and 55, and the wire W2 set in the wire receiving grooves 51 and 53 are located on the sloped surfaces of the blade 43. The wire press-in grooves 61*a*, 63*a*, 65*a* and 67*a* have cutting edges on their opposite walls. The distance between the cutting edges is smaller than the outside diameter of the wires W1 and W2. Hence, when the wires W1 and W2 are pressed into the wire press-in grooves 61*a*, 63*a*, 65*a* and 67*a*, the insulating covers of the wires W1 and W1 are cut, so that the conductors of the wires W1 and W2 are brought into contact with the cutting edges; that is, the wires W1 and W2 are electrically connected to each other through the blade 43. Thereafter, the cover 41 is engaged with the connector body 32.

The cover 41 has a wire retaining portion 69 on the inner surface at the center which is inserted between the press-connecting walls 61 and 67 and between the press-connecting walls 63 and 65. In addition, the cover 41 has wire retaining portions 71 and 73 on both sides of the aforementioned wire retaining portion 69 on the inner surface. The wire retaining portion 71 is inserted between the press-connecting walls 61 and 63 and the side wall 45*b*, while the retaining portion 73 is inserted between the press-connecting walls 65 and 67 and the side walls 45*d*. Those wire retaining portions 69, 71, 73 are engaged with the wires W1 and W2, thereby to prevent the wires W1 and W2 from disengaging from the wire press-in grooves 61*a*, 63*a*, 65*a* and 67*a*.

The cover 41 has four locking protrusions 75, 75, 75 and 75 on its outer periphery (at four corners). Those locking protrusions 75, 75, 75 and 75 are engaged with locking steps 77, 77, 77 and 77 which are formed in the side walls of the connector body 33 along the opening 39 (the locking step 77 formed on the side wall 45*c* is not shown in FIG. 1(*a*)). The cover 41 has a positioning arm 79 which extends inwardly (towards the inner surface of the cover) from the outer edge which is opposite to the inner edge from which the hinge 37 is extended. The positioning arm 79 is engaged with a positioning groove 81 formed in the side wall 45*c* of the connector body 33. A recess 83 is formed in the end portion of the positioning arm 79. The recess 83 is engagable with a positioning protrusion 85 which is formed on the bottom wall 57 of the connector body 33. Hence, when the positioning arm 79 is engaged with the positioning groove 81 while the protrusion 85 is engaged with the recess 83, the cover 41 is positioned with respect to the connector body 33.

Now, the cutting jig 87 adapted to press the wires W1 and W2 against the press-connecting blade 43 and to cut away the waste end portion 105 from the wire, will be described.

The cutting jig 87, as shown in FIG. 2(*c*), comprises: a receiving stand 89; and a pressing stand 91 which is detachably engaged with the former 89. The receiving stand 89 has a receiving recess 93, in which the connector body 33 is set.

The aforementioned protrusion 97 is extended from the bottom wall 95 which defines the receiving recess 93. The protrusion 97 is a so-called "lower blade", and it is inserted into the aforementioned hole 59 in the connector 33.

On the other hand, the pressing stand 91 has pressing protrusions 99, 101 and 103 extending downwardly. As shown in FIG. 3(*a*), the pressing protrusion 99 is used to press the wires towards the receiving stand 89 which are placed between the side wall 45*d* of the connector body 33 and the press-connecting walls 65 and 67; the pressing protrusion 101 is used to press the wires towards the receiving stand 89 which are placed between the side wall 45*b* and the press-connecting walls 61 and 63; and the remaining pressing protrusion 103 located between the pressing protrusions 99 and 101 is used to press the wires towards the receiving stand 89 which are placed between the press-connecting walls 61 and 63 and the press-connecting walls 65 and 67. The outer edge of the pressing protrusion 101 is a cutting edge which cooperates with the protrusion 97 to cut away the waste end portion 105 from the wire W2.

Now, a method of press-connecting the wires to the press-connecting joint connector will be described with reference to FIGS. 2 and 3.

First, the connector body 33 of the press-connecting joint connector 31 is set in the receiving recess 93 of the cutting jig 87. In this operation, the protrusion 97 is inserted through the hole 59 into the connector body 33 as shown in FIG. 2(*b*). Next, as shown in FIG. 2(*c*), the electrical wires W1 and W2 are placed in the wire receiving grooves 51 and 53 (only the wire W2 is shown). In this operation, the end portion of the wire W2 is set on the protrusion 97.

Under this condition, the pressing stand 91 is moved downwardly, towards the receiving stand 89, as shown in FIG. 3(*a*). As a result, the pressing protrusions 99, 101 and 103 abut against the wire W2. As the pressing stand 91 is further moved downwardly, the wire W2 is pushed into the wire press-in grooves 63*a* and 65*a*. At the same time, the pressing protrusion 101 and the protrusion 97 cooperate with each other to cut away the waste end portion 105 from the wire W2. Thereafter, the pressing stand 91 is moved upwardly to disengage from the receiving stand 89, and the press-connecting joint connector 31 in which the wires have been press-connected to each other is removed from the receiving recess 93 of the receiving stand 89.

In the above-described embodiment, simultaneously to when the wires W1 and W2 are press-connected to each other, the waste end portion 105 of the wire W2 is cut away. Hence, the waste end portion 105 is not left extended from the press-connecting joint connector 31. The cut end of the wire W2 is retained inside the connector body 33; that is, it is never shorted to the vehicle body. This feature eliminates the troublesome labor of electrically insulating the end portion of the wire W2. Thus, with the press-connecting joint connector, the wires can be connected to each other with ease.

Now, a second embodiment of the invention will be described. In the second embodiment, after the wire W2 is pushed against the press-connecting blade (43), the cutting jig (87) cuts away the waste end portion 105 from the wire.

Figure 4:
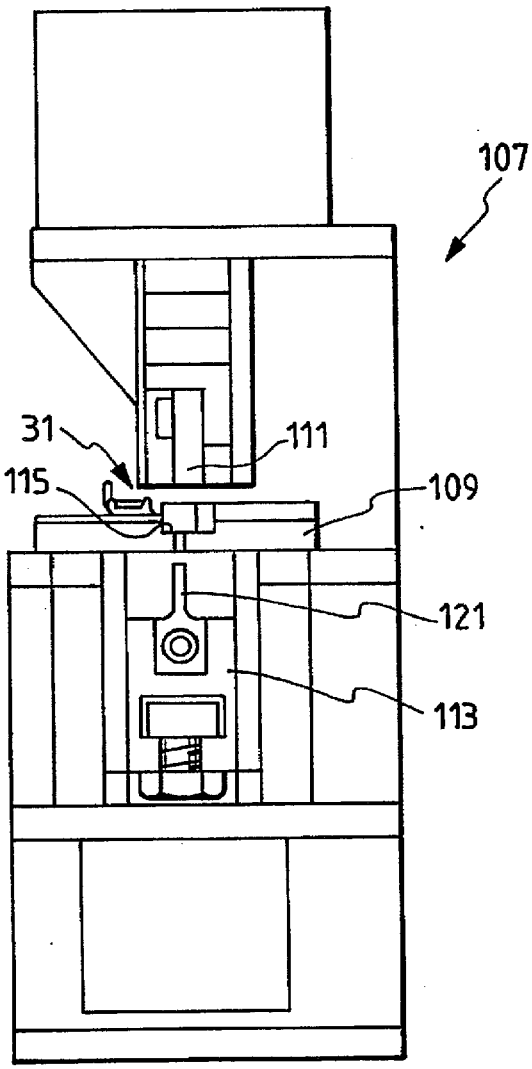
FIG. 4 is a side view showing a cutting jig according to a second embodiment of the invention.
Figure 5A:
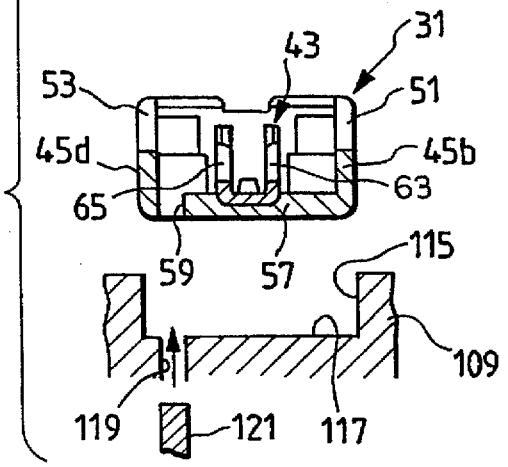
FIGS. 5(*a*)–(*c*) show a method of press-connecting electrical wires to a press-connecting joint connector according to the second embodiment of the invention wherein FIG. 5(*a*) is a sectional view showing the connector body of the press-connecting joint connector which is about to be placed in the receiving recess of the cutting jig, FIG. 5(*b*) is a sectional view showing the electrical wires which are about to be set in the connector body, and FIG. 5(*c*) is also a sectional view showing the electrical wires which have been set in the connector body.
Figure 5B:
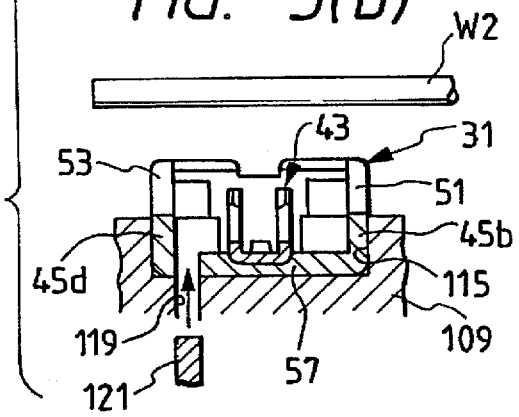
Figure 5C:
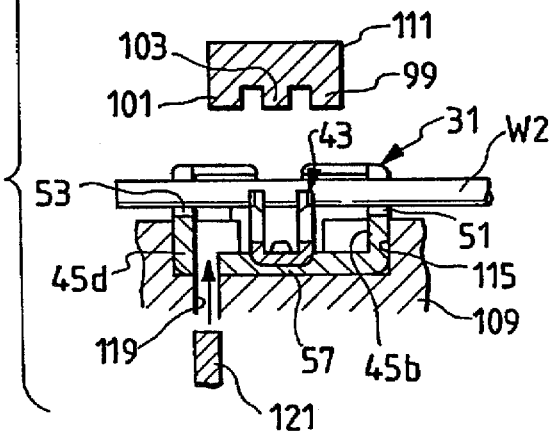

In the second embodiment, the cutting jig 107, as shown in FIG. 4, comprises a receiving stand 109, a pressing stand 111, and a movable lower blade 113. The receiving stand 109 has a receiving recess 115 in which the connector body 33 is set. As shown in FIG. 5(*a*), a through-hole 119 is formed in the bottom wall 117 which defines the receiving recess 115. The lower blade 113 has a protrusion 121 which is inserted through the through-hole 119 into the receiving recess 115. The pressing stand 111 is equal in structure to the above-described pressing stand 91.

A method of press-connecting electrical wires with the above-described cutting jig 107 will be described.

Figure 6A:
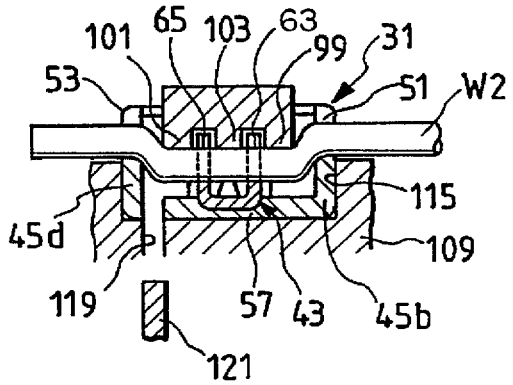
FIGS. 6(*a*) and (*b*) are diagrams for further description of the method of press-connecting electrical wires to the press-connecting joint connector according to the second embodiment of the invention wherein FIG. 6(*a*) is a sectional view showing an arrangement in which the electrical wires have been pressed with a pressing stand, and the waste end portion of one of the electrical wires has been cut away, and FIG. 6(*b*) is a sectional view showing the pressing stand which has been disengaged from the receiving stand.
Figure 6B:
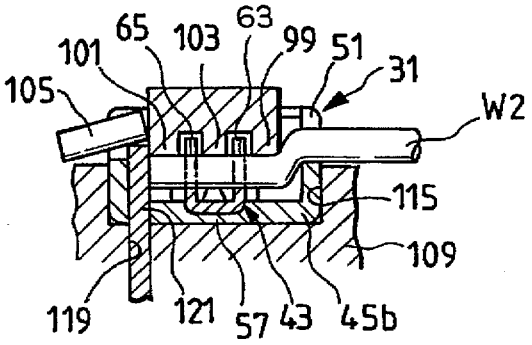
Figure 7:
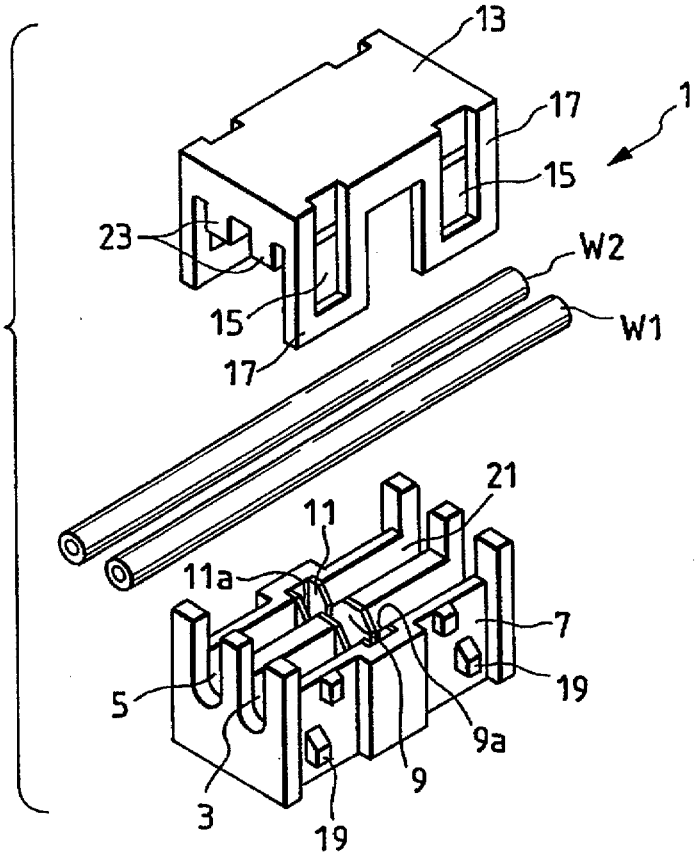
FIG. 7 PRIOR ART
FIG. 7 is an exploded perspective view showing a conventional press-connecting joint connector.
Figure 8:
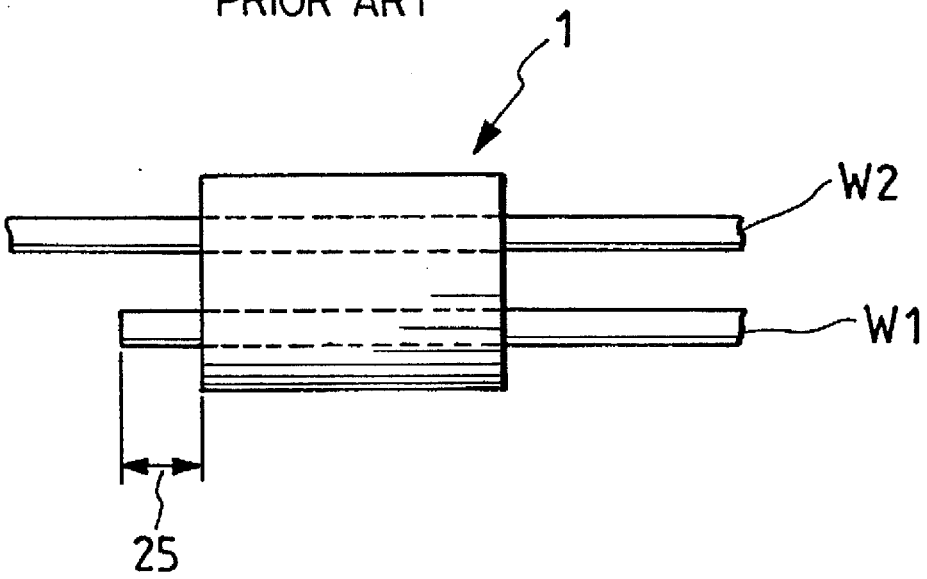
FIG. 8 PRIOR ART
FIG. 8 is a plan view of the waste end portion of an electrical wire press-connected to the conventional press-connecting joint connector.
Figure 9:
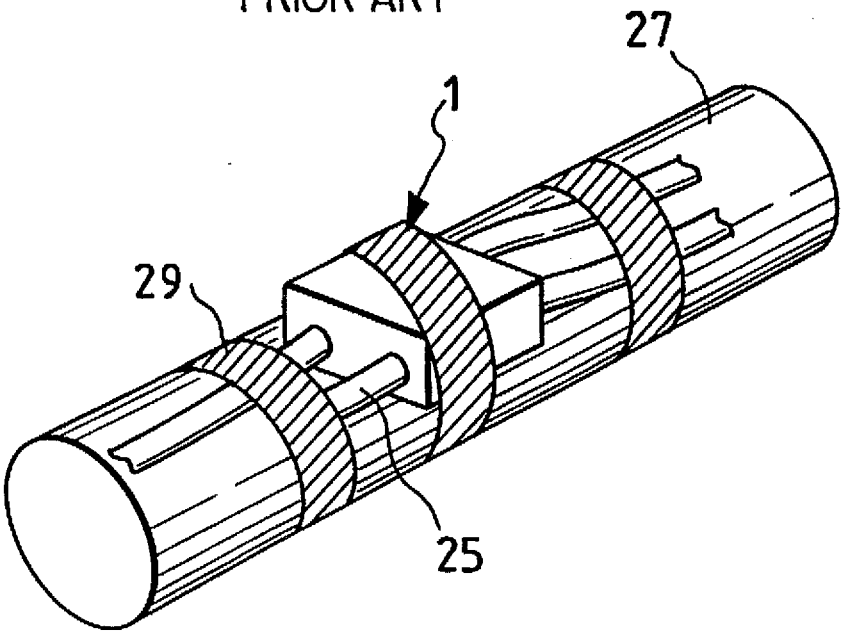
FIG. 9 PRIOR ART
FIG. 9 is a perspective view showing the conventional press-connecting joint connector which is fixedly mounted on a wire harness.

First, as shown in FIG. 5(*b*), the connector body 33 of the press-connecting joint connector 31 is set in the receiving recess 115 of the cutting jig 107. In this case, the hole 59 of the connector body 33 is communicated with the through-hole 119 of the receiving stand 109. Under this condition, the wire W2 is set in the wire receiving grooves 51 and 53 as shown in FIG. 5(*c*). Thereafter, the pressing stand 111 is moved downwardly, towards the receiving stand 109, as shown in FIG. 6(*a*), so that the pressing protrusions 99, 101 and 103 are abutted against the wire W2. When the pressing stand 111 is further moved downwardly, the wire W2 is pushed in the wire press-in grooves 63*a* and 65*a*. Next, the lower blade 113 is moved upwardly so that the protrusion 121 is inserted into the hole 119. Upon insertion of the protrusion 121 into the hole 119, the protrusion 121 cooperates with the pressing protrusion 101 to cut away the waste end portion 105 from the wire. After the pressing 111 is moved upwardly to disengage from the receiving stand 109, the press-connecting joint connector 31 in which the wires have been press-connected to each other is removed from the receiving recess 115 of the receiving stand 109.

In the second embodiment, after the wires W1 and W2 are press-connected to each other, the waste end portion of the wire W2 is cut away. Hence, the cut end of the wire W2 is retained inside the connector body 33; that is, the waste end portion 105 is never left extended from the connector body 33. This feature eliminates the troublesome labor of electrically insulating the end portion of the wire W2. Thus, with the press-connecting joint connector, the wires can be connected to each other with ease.

In the above-described embodiments, the wire W2 which is the branch wire is connected to the wire W1 which is the main wire, and the wire W2 is cut to remove the waste end portion; however, the invention is not limited thereto or thereby. That is, the technical concept of the invention may be applied to the case where the end portions of the wires W1 and W2 are connected to each other with the press-connecting joint connector, and the waste end portions of those wires W1 and W2 should be cut away inside the connector body.

According to a second aspect, the wires are inserted in the wire inserting section, and simultaneously to when the wires thus inserted are pressed against the press-connecting blade so as to be press-connected to one another, the waste end portion of at least one of-the wires is cut away inside the connector body. Hence, the waste end portion is never left extended from the connector body. This feature eliminates the troublesome labor of electrically insulating the end portion of the wire. Thus, with the press-connecting joint connector, the wires can be connected to each other with ease.

According to a second aspect, the wires are inserted in the wire inserting section, and after the wires thus inserted are pressed against the press-connecting blade so as to be press-connected to one another, the waste end portion of at least one of the wires is cut away inside the connector body. Hence, similarly as in the case of the above-described method, the waste end portion is never left extended from the connector body. This feature eliminates the troublesome labor of electrically insulating the end portion of the wire. Thus, with the press-connecting joint connector, the wires can be connected to each other with ease.

According to yet another aspect of the invention, the wires are inserted in the wire inserting section of the connector body, and pressed against the press-connecting blade. The cutting jig which, simultaneously to when or after the wires are pressed against the press-connecting blade, cuts away the waste end portion of at least one of the wires inside the connector body, is inserted through the hole into the connector body, thereby to cut away the waste end portion from the wire. Hence, the waste end portion is never left extended from the connector body. This feature also eliminates the troublesome labor of electrically insulating the end portion of the wire W2. Thus, with the press-connecting joint connector, the wires can be connected to each other with ease.

What is claimed is:

1. A press-connecting joint connector comprising:

a connector housing defining a wire inserting section therein, said connector housing having an opening on an upper side thereof;

a wire retaining member disposed in said wire inserting section, said wire retaining member including at least a pair of wire cutting blades for cutting the insulation of said wires so as to electrically interconnect said wires, wherein said connector housing includes a cutter receiving hole provided in a bottom surface thereof into which a cutter is insertable to cut a waste end portion of at least one of said plurality of wires inside said connector body;

a cover for covering said opening; and a receiving stand having a receiving portion for fixedly retaining said connector body, said cutter being fixedly secured to said receiving stand and extending therefrom.

2. The connector of claim 1, wherein said wire cutting blades each includes opposing blades defining a slot therebetween into which each said wire is pressed.

3. The connector of claim 2, further comprising a wire pressing member including a plurality of projections for respectively pressing said wires into each said slot, one of said projections cooperating with said cutter for cutting said waste end portion.

* * * * *